United States Patent [19]

Buchmüller et al.

[11] 4,227,468

[45] Oct. 14, 1980

[54] IMMERSION PIECE FOR THE ASH FUNNEL OF A COMBUSTION CHAMBER

[75] Inventors: Horst Buchmüller, Hünxe; Bernhard Michelbrink, Wesel, both of Fed. Rep. of Germany

[73] Assignee: Deutsche Babcock Aktiengesellschaft, Oberhausen, Fed. Rep. of Germany

[21] Appl. No.: 6,579

[22] Filed: Jan. 26, 1979

[30] Foreign Application Priority Data

Jul. 11, 1978 [DE] Fed. Rep. of Germany ..... 2830372

[51] Int. Cl.[3] ..... F23J 1/00

[52] U.S. Cl. ..... 110/165 R; 110/165 A; 110/171; 110/259; 414/214

[58] Field of Search ..... 110/165 R, 165 A, 171, 110/167, 168, 259; 198/616, 716, 728; 414/214

[56] References Cited

U.S. PATENT DOCUMENTS 3,915,105 10/1975 Michelbrink ..... 110/165 R
3,958,518 5/1976 Yoshida ..... 110/259

FOREIGN PATENT DOCUMENTS 1930432 12/1970 Fed. Rep. of Germany ..... 110/171

*Primary Examiner*—Henry C. Yuen
*Attorney, Agent, or Firm*—Max Fogiel

[57] ABSTRACT

An immersion plate fastened to the ash funnel of a steam generator combustion chamber and protruding into the water surface of a trough of a wet-ash remover filled with quenching water and located underneath the ash funnel. Carriers pass transversely through the immersion piece and are suspended by screws from the tubing of the funnel; a seal which is deformable in the direction of action of the screws is located between the immersion piece and the ash funnel. The cooled carriers may consist of two U-profiles welded together and the carrier ends outside the immersion pieces may be open. A U-shaped profile with the opening upwards is mounted on part of the carrier lying within the immersion piece. The sidewalls of the immersion piece may consist of several plate sections and each plate section has, at one edge, a slot for the edge of the adjacent plate, with play in the longitudinal direction. The screws are suspended pendulum-like from the ash funnel and the screw shanks pass through enlarged bores in the carrier; skirt-shaped support washers are located between the carrier and the nuts on the screws.

6 Claims, 5 Drawing Figures

IMMERSION PIECE FOR THE ASH FUNNEL OF A COMBUSTION CHAMBER

BACKGROUND OF THE INVENTION

The present invention relates to an immersion piece, which is fastened to the ash funnel of the combustion chamber of a steam generator and which protrudes into the water surface of a trough of a wet ash remover filled with quenching water and arranged underneath the ash funnel.

Such immersion pieces serve for the sealing of the interior of the boiler against the external atmosphere. The longer the ash funnel of the boiler, the heavier the immersion piece so that it can no longer be fastened in a simple manner to the ash funnel. Because of the temperatures prevailing underneath the ash funnel, the danger exists that the immersion piece becomes warped. As a consequence thereof, leakages and air in filtration can occur.

It is an object of the present invention to fasten the immersion piece at the ash funnel in such a manner that a secure connection of the immersion piece to the ash funnel is assured even with large dimensions.

Another object of the present invention is to provide an arrangement of the foregoing character which is substantially simple in construction and may be economically fabricated.

A further object of the present invention is to provide an immersion piece, as described, which may be readily maintained in service and which has a substantially long operating life.

SUMMARY OF THE INVENTION

The objects of the present invention are achieved by having the immersion piece penetrated transversely by cooled carriers (or beams) which are suspended by screws from the tubing of the ash funnel and providing a seal deformable in the direction of action of the screws between the immersion piece and the ash funnel.

With this arrangement, the immersion piece can be drawn sealingly against the ash funnel. Thermal expansions of the immersion piece are absorbed by the seal, if necessary in conjunction with a pendulum-like suspension of the screws, without leakages arising.

The carriers can be exposed to water flow. A particularly simple cooling of the carriers can be attained, when in an advantageous embodiment of the invention, the cooled carrier consists of two U-profiles welded together and the ends of the carrier lying externally of the immersion piece are open. Furthermore, a U-shaped profile with the opening upwards may be mounted on the part of the carrier lying within the immersion piece. It has been found that the air flowing through the carriers thus formed, especially in conjunction with the heat insulation required by the ash collecting on the U-shaped profile, suffices to cool these carriers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
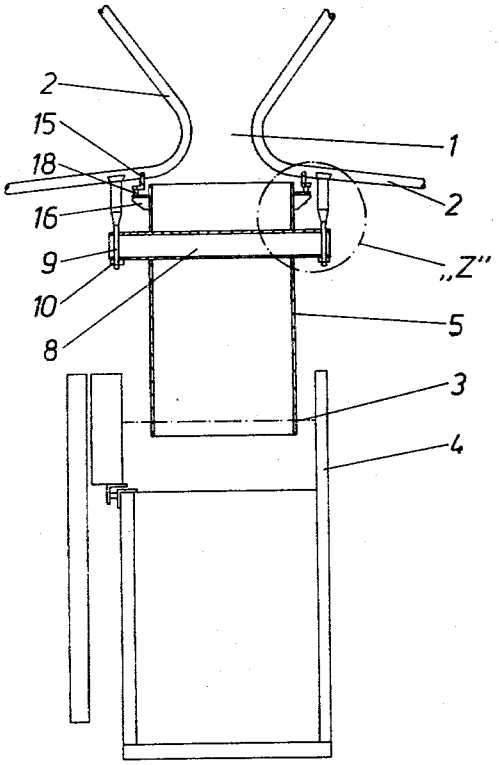
FIG. 1 shows partially in section, the front elevation of an immersion piece according to the present invention.
Figure 2:
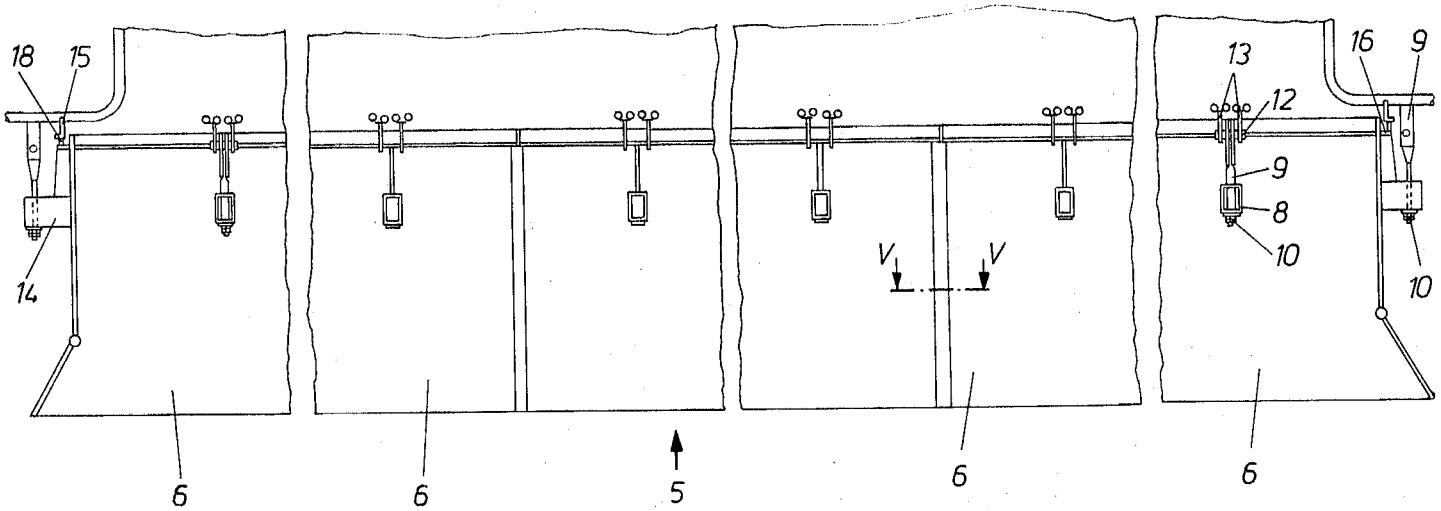
FIG. 2 shows the associated side elevation.
Figure 3:
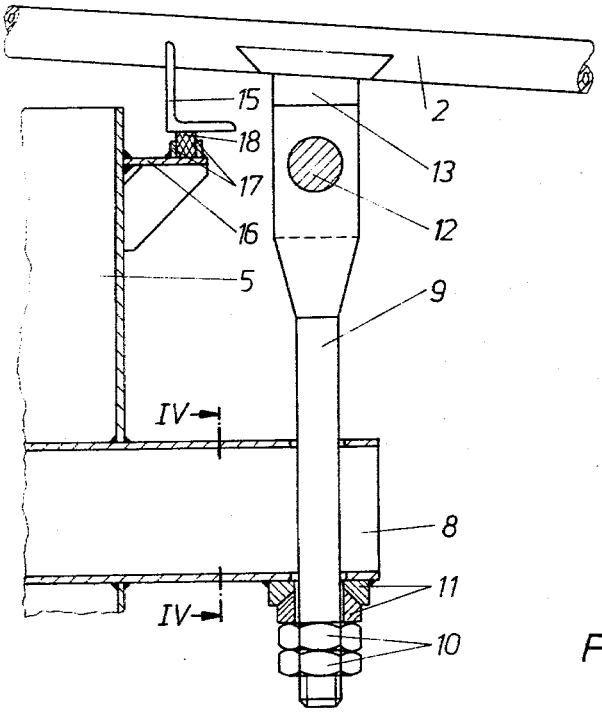
FIG. 3 shows the detail Z according to FIG. 1.
Figure 4:
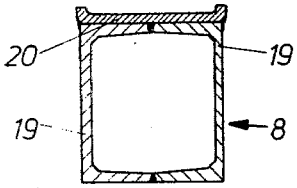
FIG. 4 shows a section taken along line IV—IV in FIG. 3.
Figure 5:
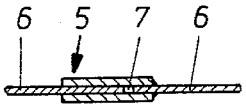
FIG. 5 shows a section taken along line V—V in FIG. 2.

Only the lower part of the combustion chamber, which consists of the ash funnel 1, of a boiler plant is illustrated. The ash funnel 1 is built up of cooling pipes 2 welded together to be gas-tight by interposed webs.

A wet ash remover, which consists of a trough 4 filled with quenching water up to the line 3, is arranged underneath the ash funnel 1. A scraper chain conveyor, which carries away the ash cooled in the quenching water to the outside, is guided through the upwardly open trough 4.

An immersion piece 5, which represents the downward extension of the ash funnel 1 and which constantly immerses into the water level 3 within the trough 4 of the wet ash remover, is provided for sealing off the interior of the boiler. The immersion piece 5 consists of steel plates and is fastened to the ash funnel 1 as described later in more detail. In the case of particularly long ash funnels 1, the longitudinal sides of the immersion piece 5 can consist of several plate sections 6. In that case, one edge of a plate section 6 is provided with a slot 7 by welded-on strips. The edge of the adjacent plate section 6 loosely and with play enters into the slot 7 in the longitudinal direction of the immersion piece 5. In this manner, a distortion of the plate sections 6 of the immersion piece 5 is counteracted.

Several carriers 8 are drawn transversely through the immersion piece 5. Screws 9 serving as retaining elements are guided through enlarged bores in the projecting ends of the carrier 8. Two support washers 11 with skirt-shaped support surfaces are provided between the carrier 8 and the nut 10. A bolt 12, which is fastened in two retaining irons 13, is plugged through the thickened upper part of the screws 9. The retaining irons 13 are welded to the webs between the cooling pipes 2 of the ash funnel 1. In this manner, a relative inclined position between the screws 9 and the carriers 8 is permitted. A similar mounting is provided at the transverse sides of the immersion piece 5, for which, however, carrier sections 14 are employed, which are mounted only externally on the wall of the immersion piece 5.

An angled metal comb plate 15 is welded to the webs of the cooling pipes 2. An encircling web 16 is mounted on the immersion piece 5 at a short distance underneath this comb plate 15. The encircling web 16 holds a plastically deformable, continuous sealing strip 18 between two guides 17 of small height. A sealing between the immersion piece 5 and the ash funnel 1 is attained through the sealing strip 18 by appropriate tightening of the nuts 10 of the screws 9.

The carriers 8 led transversely through the immersion piece 5 are cooled. For this purpose, they are formed of two U-profiles 19 welded together into a hollow carrier. The ends of the carrier lying externally of the immersion piece 5 are open so that the surrounding air can flow through the hollow space of the carriers 8. A U-shaped profile 20 is placed, with its opening upwardly, on the upper side of the section of the carrier 8 lying within the immersion piece 5. The ash trickling down collects in the U-shaped profile 20 in the manner of a tub. The cooled ash effects a certain heat insulation. Together with this heat insulation, the external air flowing through the carriers 8 by reason of the natural draft suffices to cool the carriers 8. At the same time, the ash cushion provides a good protection against wear from additional ash trickling down.

The wet ash remover arranged underneath the ash funnel is described in the preceding embodiment in conjunction with a scraper chain conveyor. It can, of course, also be used with other units, for example with plate belt conveyors.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An immersion member for an ash funnel forming the bottom part of a steam generator combustion chamber and being formed of tubes, said immersion member protruding into the water level of a trough filled with quenching water and located underneath said ash funnel for receiving ash from the ash funnel; fastening means for connecting said immersion member to said ash funnel, said fastening means comprising; carrier means and screw means connected to said ash funnel, said carrier means being cooled and passing transversely through said immersion member; said carrier means being suspended from the ash funnel by said screw means; and seal means located between said immersion member and said ash funnel and being deformable in vertical direction.

2. An immersion member as defined in claim 1 wherein said cooled carrier means comprises two U-shaped profiled members welded together, ends of said carrier means lying outside of said immersion member being open.

3. An immersion member as defined in claim 2 wherein one of said U-shaped members has an opening upwards directed toward said ash funnel, the other one of said U-shaped profiled members being mounted on a part of said carrier means lying inside said immersion member.

4. An immersion member as defined in claim 1 including sidewalls comprising a plurality of plate sections, each plate section having a slot and edges, each edge being associated with a slot, one edge of each adjacent plate section being inserted with play in said slot in a longitudinal direction.

5. An immersion member as defined in claim 1 including skirt-shaped support washers and nuts, said washers being located between said nuts and said carrier means, said screw means being suspended from said ash funnel in a pendulum-like manner and having shanks passing through enlarged bores in said carrier means.

6. An immersion member as defined in claim 1 including sidewalls comprising a plurality of plate sections, each plate section having a slot and edges, each edge being associated with a slot, one edge of each adjacent plate section being inserted with play in said slot in a longitudinal direction; said cooled carrier means comprising two U-shaped profiled members welded together, ends of said carrier means lying outside of said immersion member being open, one of said U-shaped profiled member having an opening directed upwards towards said ash funnel, the other one of said U-shaped profiled members being mounted on a part of said carrier means lying inside said immersion member; skirt-shaped support washers and nuts, said washers being located between said nuts and said carrier means, said screw means being suspended from said ash funnel in a pendulum-like manner and having shanks passing through enlarged bores in said carrier means, said seal means allowing for differential expansion between the cooled ash funnel and uncooled immersion piece.

* * * * *